US011037509B2

(12) United States Patent
Hou et al.

(10) Patent No.: US 11,037,509 B2
(45) Date of Patent: Jun. 15, 2021

(54) PIXEL DRIVING CIRCUIT AND DISPLAY DEVICE HAVING THE SAME FOR ELIMINATING IMPROPER IMAGE-DISPLAYING OF OLED DISPLAY RESULTING FROM DRIFTING OF THRESHOLD VOLTAGE OF DRIVING TFT

(71) Applicant: Wuhan China Star Optoelectronics Semiconductor Display Technology Co., Ltd., Hubei (CN)

(72) Inventors: Xueshun Hou, Hubei (CN); Xue Li, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 596 days.

(21) Appl. No.: 15/775,609

(22) PCT Filed: Feb. 12, 2018

(86) PCT No.: PCT/CN2018/076542

§ 371 (c)(1),
(2) Date: May 11, 2018

(87) PCT Pub. No.: WO2019/119638

PCT Pub. Date: Jun. 27, 2019

(65) Prior Publication Data

US 2021/0082351 A1 Mar. 18, 2021

(30) Foreign Application Priority Data

Dec. 22, 2017 (CN) ..... 201711405794.X

(51) Int. Cl.
*G09G 3/3291* (2016.01)
*G09G 3/3258* (2016.01)
*G09G 3/3266* (2016.01)

(52) U.S. Cl.
CPC ..... *G09G 3/3291* (2013.01); *G09G 3/3258* (2013.01); *G09G 3/3266* (2013.01)

(58) Field of Classification Search
CPC ... G09G 3/3291; G09G 3/3258; G09G 3/3266
See application file for complete search history.

(56) References Cited

U.S. PATENT DOCUMENTS 10,726,790 B2 * 7/2020 Shi ..... G09G 3/3258
2015/0061538 A1 * 3/2015 Miyazawa ..... G09G 3/3266 315/291

(Continued)

FOREIGN PATENT DOCUMENTS

CN 104700776 A 6/2015
CN 106340270 A 1/2017

(Continued)

*Primary Examiner* — Lisa S Landis
(74) *Attorney, Agent, or Firm* — Leong C. Lei

(57) ABSTRACT

The present disclosure relates to a pixel driving circuit having a pixel structure of 7T1C to compensate a threshold voltage of a driving thin film transistor (TFT) in the organic light-emitting diode (OLED). As such, the current passing through the OLED may not be related to the threshold voltage of the driving TFT. Thus, the improper image-displaying of the OLED display caused by the drifting of the threshold voltage of the driving TFT may be reduced.

18 Claims, 4 Drawing Sheets

(56) References Cited

U.S. PATENT DOCUMENTS

| | | | | |
|---|---|---|---|---|
| 2016/0104427 | A1* | 4/2016 | Matsueda | G09G 3/3233<br>345/212 |
| 2017/0263183 | A1* | 9/2017 | Lin | G09G 3/3233 |
| 2019/0304367 | A1* | 10/2019 | Li | G09G 3/3258 |

FOREIGN PATENT DOCUMENTS

| | | | |
|---|---|---|---|
| CN | 107195274 | A | 9/2017 |
| CN | 107293258 | A | 10/2017 |
| CN | 107437399 | A | 12/2017 |

* cited by examiner

PIXEL DRIVING CIRCUIT AND DISPLAY DEVICE HAVING THE SAME FOR ELIMINATING IMPROPER IMAGE-DISPLAYING OF OLED DISPLAY RESULTING FROM DRIFTING OF THRESHOLD VOLTAGE OF DRIVING TFT

RELATED APPLICATIONS

The present application is a National Phase of International Application Number PCT/CN2018/076542, filed Feb. 12, 2018, and claims the priority of China Application No. 201711405794.X, filed Dec. 22, 2017.

BACKGROUND

1. Technical Field

The present disclosure relates to display field, and more particularly to a pixel driving circuit and a display device having the same.

2. Description of Related Art

Organic light-emitting diode (OLED) displays have been popular flat panel display products due to the attributes, such as self-illuminating, wide viewing angle, short response time, high luminous efficiency, wide color gamut, low operating voltage, thin thickness. In addition, the OLED may be adopted in large-scale and flexible displays via simple manufacturing process. Moreover, the cost of OLED displays is low.

With respect to OLED displays, thin film transistors (TFTs) often cooperate with capacitor storage signals to control the gray scale of the OLED so as to drive the OLED at a constant current. Each of the pixels at least includes two thin film transistors (TFT)s and a storage capacitor, i.e., each of the pixels has a 2T1C structure. FIG. 1 is a circuit diagram of a pixel driving circuit of conventional OLED displays. Referring to FIG. 1, the pixel driving circuit of the conventional OLED displays may include two TFT and a capacitor. Specifically, the pixel driving circuit of the conventional OLED displays may include a switch TFT T1, a driving TFT T2, and a storage capacitor $C_{st}$. Driving current of the OLED is controlled by the driving TFT T2. The current may satisfy the equation: $I_{OLED}=k(V_{GS}-V_{th})^2$, wherein k is an intrinsic conductance factor of the driving TFT T2, which is determined by the characteristic of the driving TFT T2. $V_{th}$ is threshold voltage of the driving TFT T2. $V_{gs}$ is a voltage between a gate and a source of the driving TFT T2. Due to the long-term operation, the threshold voltage $V_{th}$ of the driving TFT T2 may drift, causing the driving current of the OLED change. Thus, the OLED display may not operate properly, which may impacts the quality of the displays.

SUMMARY

In one aspect, the present disclosure relates to a pixel driving circuit, including: a first thin film transistor (TFT), a second TFT, a third TFT, a fourth TFT, a fifth TFT, a sixth TFT, a seventh TFT, a capacitor, and an organic light-emitting diode (OLED); wherein, during a reset phase, the fourth TFT is turned on to provide a reference voltage to a first end of the capacitor, and the fifth TFT is turned on and then turned off to provide a power supply voltage to a second end of the capacitor, during a threshold voltage compensating phase, the second TFT is turned on to provide a data voltage to a gate electrode of the first TFT, the fourth TFT is maintained to be in a turn-on state, so as to maintain a voltage of the first end of the capacitor to be equal to the reference voltage, and the first TFT and the third TFT are turned on such that the second end of the capacitor is discharged until a voltage equal to a voltage difference between the data voltage and a threshold voltage of the first TFT, and the first TFT is turned off; during an emission driving phase, the fifth TFT is turned on to provide the power supply voltage to the first end of the first TFT, the seventh TFT is turned on to provide a voltage of the capacitor to the gate electrode of the first TFT, the sixth TFT is turned on such that a driving current being provided from the second end of the first TFT to the OLED via the sixth TFT.

The first TFT, the second TFT, the third TFT, the sixth TFT, and the seventh TFT are in a turn-off state during the reset phase.

The fifth TFT, the sixth TFT, and the seventh TFT are in a turn-off state during the threshold voltage compensating phase.

The second TFT, the third TFT, and fourth TFT are in a turn-off state during the emission driving phase.

The gate electrode of the first TFT connects to a first node, a first end of the first TFT connects to a second node, and a second end of the first TFT connects to a third node; a gate electrode of the second TFT is configured to receive scanning signals, a second end of the second TFT connects to the first node, and a first end of the second TFT is configured to receive the data voltage; a gate electrode of the third TFT is configured to receive the scanning signals, a second end of the third TFT connects to the third node, and a first end of the third TFT connects to the first node; a gate electrode of the fourth TFT is configured to receive reset signals, a first end of the fourth TFT is configured to receive the reference voltage, and a second end of the fourth TFT connects to a fourth node; a gate electrode of the fifth TFT is configured to receive enabling signals, a first end of the fifth TFT is configured to receive the power supply voltage, and a second end of the fifth TFT connects to the second node; a gate electrode of the sixth TFT is configured to receive the enabling signals, a first end of the sixth TFT connects to the third node, and a second end of the sixth TFT connects to the OLED; a gate electrode of the seventh TFT is configured to receive the enabling signals, a first end of the seventh TFT connects to the fourth node, and a second end of the seventh TFT connects the first node; a first end of the capacitor connects to the fourth node, and a second end of the capacitor connects to the second node.

During the reset phase, the reset signals are maintained to be at a low potential, the scanning signals are maintained to be at a high potential, the enabling signals are maintained to be at the low potential during a first predetermined time period, and the enabling signals transits from the low potential into the high potential when the first predetermined time period expires.

During the threshold voltage compensating phase, the enabling signals are maintained to be at the high potential, the reset signals are maintained to be at the low potential during a second predetermined time period, the reset signals transits from the low potential into the high potential when the second predetermined time period expires, the scanning signals are maintain to be at the low potential during a third predetermined time period, and the scanning signals transits from the low potential into the high potential when the third predetermined time period expires.

During the emission driving phase, the enabling signals are maintained to be at the low potential, and the reset signals and the scanning signals are maintained to be at the high potential.

The first TFT, the second TFT, the third TFT, the fourth TFT, the fifth TFT, the sixth TFT, and the seventh TFT are P-trench TFTs.

In another aspect, the present disclosure relates to a display device including the pixel driving circuit.

In view of the above, the pixel driving circuit may adopt the pixel structure of 7T1C to compensate the threshold voltage of the driving TFT in the OLED. As such, the current passing through the OLED may not be related to the threshold voltage of the driving TFT, so as to eliminate the improper image-displaying of the OLED display resulting from the drifting of the threshold voltage of the driving TFT.

DETAILED DESCRIPTION

Figure 1:
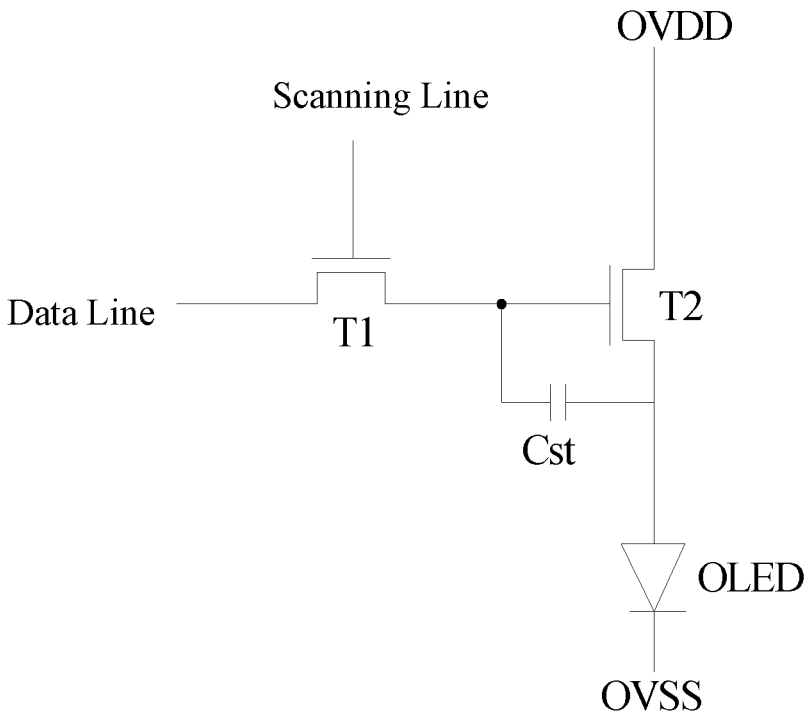
FIG. 1 PRIOR ART
FIG. 1 is a circuit diagram of a pixel driving circuit of a conventional organic light-emitting diode (OLED) display.

Following embodiments of the invention will now be described in detail hereinafter with reference to the accompanying drawings. However, there are plenty of forms to implement the present disclosure, and the invention should not be construed as limitation to the embodiments. Rather, these embodiments are provided to explain the principles of the invention and its practical application, thereby enable other person skilled in the art to understand each of the embodiments in the invention and various modifications being suitable for the particular application.

In the drawings, the thicknesses of layers and regions may be exaggerated for clarity. Same reference numerals refer to the same components throughout the specification and the drawings.

Figure 2:
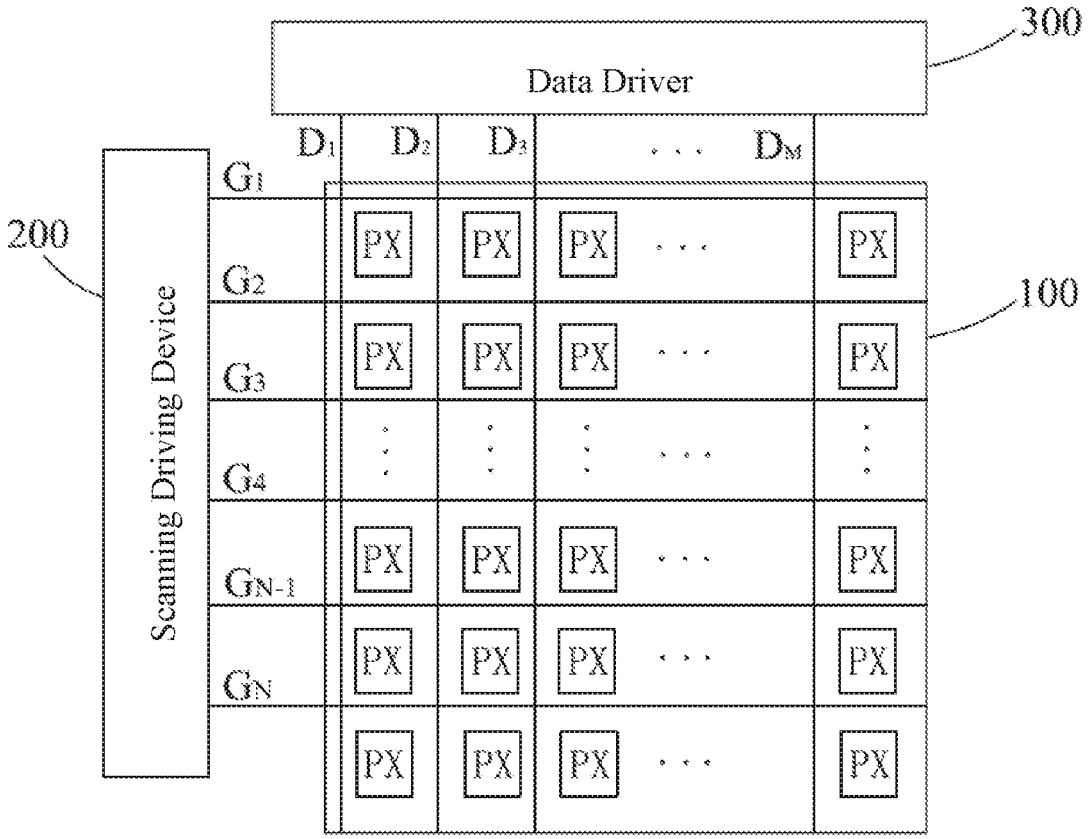
FIG. 2 is a schematic view of an OLED display in accordance with one embodiment in the present disclosure.

FIG. 2 is a schematic view of an OLED display in accordance with one embodiment in the present disclosure.

Referring to FIG. 2, the present disclosure relates to an organic light-emitting diode (OLED) display, including: a display panel 100, a scanning driver 200, and a data driver 300. It is noted that the OLED display in the present disclosure may further include other proper components, such as a timing controlling device configured to control the scanning driver 200 and the data driver 300, and a power supply voltage generator configured to provide a positive voltage of a power supply and a negative voltage of the power supply.

Specifically, the display panel 100 may include: a plurality of pixel PX arranged in a matrix, n number of scanning lines $G_1$ to $G_N$, m number of data lines $D_1$ to $D_M$. The scanning driver 200 connects to each of the scanning lines $G_1$ to $G_N$ and drives each of the scanning lines $G_1$ to $G_N$. The data driver 300 connects to each of the data lines $D_1$ to $D_M$ and drives each of the data lines $D_1$ to $D_M$.

The scanning driver 200 may provide at least one signal to each of the pixels PX, which may be described in detail later. The data driver 300 may provide data signals to each of the pixels PX, which may also be described in detail later.

Each of the pixels PX may include a pixel driving circuit. The pixel driving circuit in the present disclosure may be described in detail as below.

Specifically, the display panel 100 may include: a plurality of pixel PX arranged in a matrix, n number of scanning lines $G_1$ to $G_N$, m number of data lines $D_1$ to $D_M$. The scanning driver 200 connects to each of the scanning lines $G_1$ to $G_N$ and drives each of the scanning lines $G_1$ to $G_N$. The data driver 300 connects to each of the data lines $D_1$ to $D_M$ and drives each of the data lines $D_1$ to $D_M$.

The scanning driver 200 may provide at least one signal to each of the pixels PX, which may be described in detail later. The data driver 300 may provide data signals to each of the pixels PX, which may also be described in detail later.

Each of the pixels PX may include a pixel driving circuit. The pixel driving circuit in the present disclosure may be described in detail as below.

Figure 3:
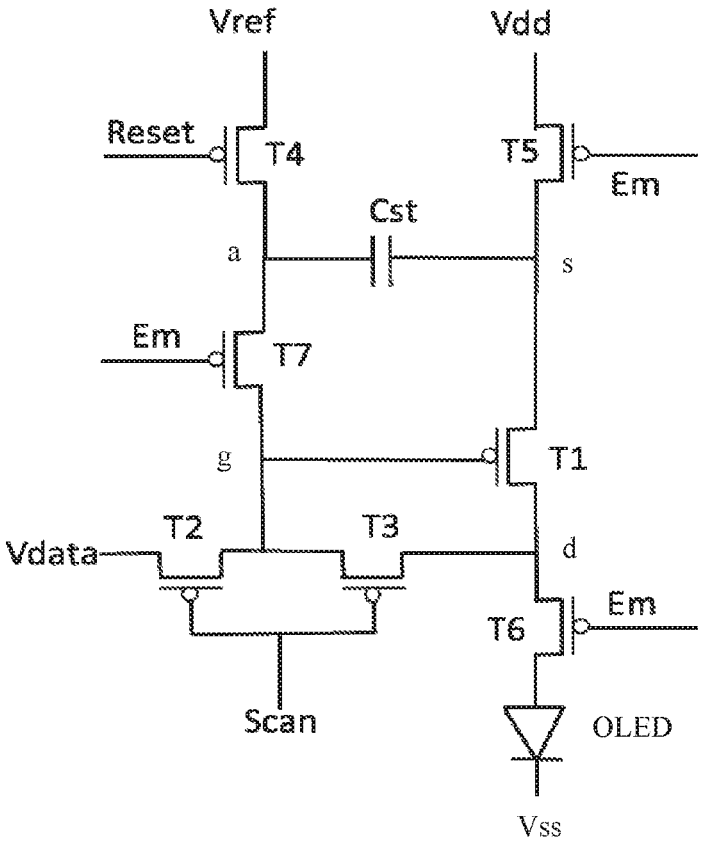
FIG. 3 is a circuit diagram of a pixel driving circuit in accordance with one embodiment in the present disclosure.

FIG. 3 is a circuit diagram of a pixel driving circuit in accordance with one embodiment in the present disclosure.

Referring to FIG. 3, each of the pixels PX of the OLED display may include a 7T1C pixel structure. The 7T1C pixel structure includes an OLED, a first thin film transistor (TFT) T1, a second TFT T2, a third TFT T3, a fourth TFT T4, a fifth TFT T5, a sixth TFT T6, a seventh TFT T7, and a capacitor "$C_{st}$".

A gate electrode of the first TFT T1 electrically connects to a first node "g". A first end of the first TFT T1 electrically connects to a second node "s". A second end of the first TFT T1 electrically connects to a third node "d".

A gate electrode of the second TFT T2 is configured to receive scanning signals "Scan", which are provided by the scanning driver 200. A first end of the second TFT T2 is configured to receive a data voltage "$V_{data}$", which are provided by the data driver 300. A second end of the second TFT T2 electrically connects to the first node "g". In one example, the data voltage "$V_{data}$" is configured to be at a high potential.

A gate electrode of the third TFT T3 is configured to receive the scanning signals "Scan". A first end of the third TFT T3 electrically connects to the first node "g". A second end of the third TFT T3 electrically connects to the third node "d".

A gate electrode of the fourth TFT T4 is configured to receive reset signals "Reset". A first end of the fourth TFT T4 is configured to receive a reference voltage "$V_{ref}$". A second end of the fourth TFT T4 electrically connects to a fourth node "a".

A gate electrode of the fifth TFT T5 is configured to receive enabling signals "Em". A first end of the fifth TFT T5 is configured to receive the positive voltage of the power supply "$V_{dd}$", which is usually generated and provided by a power generator (not shown) of the OLED display. A second end of the fifth TFT T5 electrically connects to the second node "s".

A gate electrode of the sixth TFT T6 is configured to receive the enabling signals "Em". A first end of the sixth TFT T6 electrically connects to the third node "d". A second end of the sixth TFT T6 connects to an anode of the OLED.

A gate electrode of the seventh TFT T7 is configured to receive the enabling signals "Em". A first end of the seventh TFT T7 electrically connects to the fourth node "a". A second end of the seventh TFT T7 connects the first node "g".

A first end of the capacitor "$C_{st}$" electrically connects to the fourth node "a", and a second end of the capacitor "$C_{st}$" electrically connects to the second node "s".

A cathode of the OLED is configured to receive the negative voltage of the power supply "$V_{ss}$" which is usually generated and provided by the power generator (not shown) of the OLED. In one example, the positive voltage of the power supply "$V_{dd}$" is configured to be at the high potential, the negative voltage of the power supply "$V_{ss}$" is configured to be at a low potential, and the positive voltage of the power supply "$V_{dd}$" is greater than the negative voltage of the power supply "$V_{ss}$".

In one example, the first TFT T1 is a driving TET.

The first ends of each of the first TFT T1, the second TFT T2, the third TFT T3, the fourth TFT T4, the fifth TFT T5, the sixth TFT T6, and the seventh TFT T7 may be a source electrode or a drain electrode. The second ends of each of the first TFT T1, the second TFT T2, the third TFT T3, the fourth TFT T4, the fifth TFT T5, the sixth TFT T6, and the seventh TFT T7 may be an electrode different from the first end.

For example, when the first end is the drain electrode, the second end is the source electrode. When the first end is the source electrode, the second end is the drain electrode.

The first TFT T1, the second TFT T2, the third TFT T3, the fourth TFT T4, the fifth TFT T5, the sixth TFT T6, and the seventh TFT T7 may be the TFTs having the same trench type.

For example, the first TFT T1, the second TFT T2, the third TFT T3, the fourth TFT T4, the fifth TFT T5, the sixth TFT T6, and the seventh TFT T7 may be P-trench TFTs.

The first TFT T1, the second TFT T2, the third TFT T3, the fourth TFT T4, the fifth TFT T5, the sixth TFT T6, and the seventh TFT T7 may adopt polysilicon TFTs, amorphous silicon TFTs, or oxide TFTs.

Figure 4:
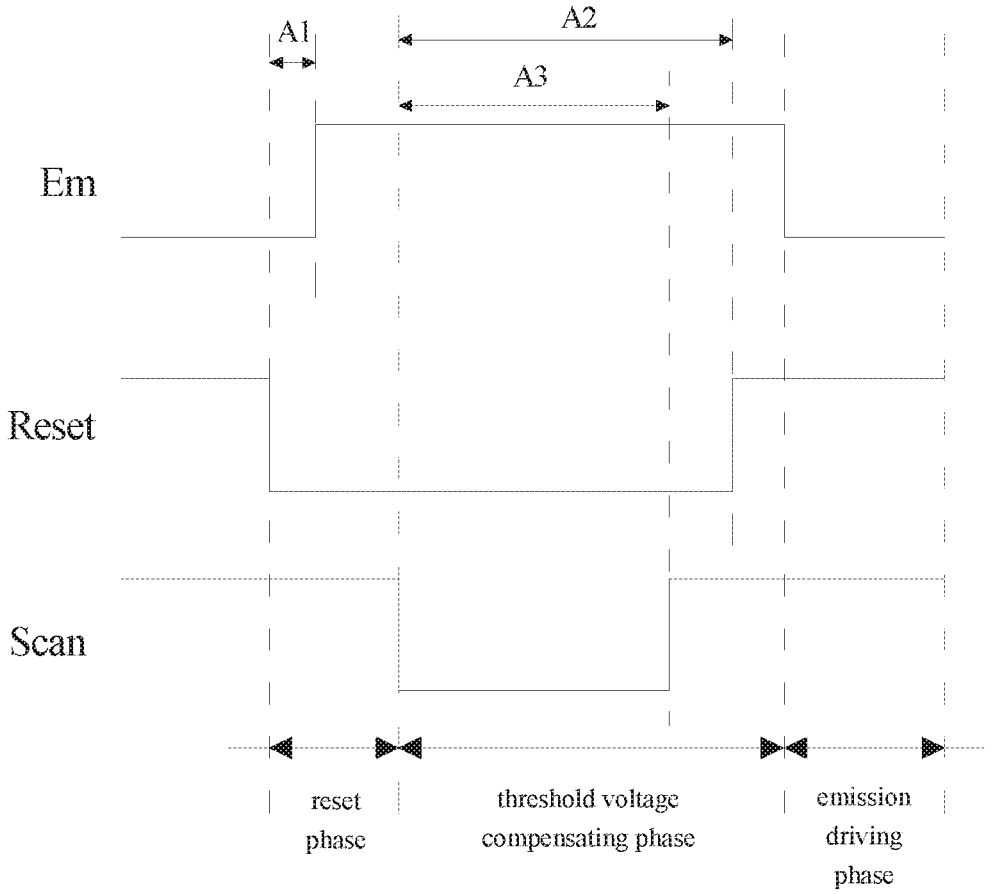
FIG. 4 is a timing diagram of each of signals in accordance with one embodiment in the present disclosure.

Operation principles of the pixel driving circuit in the present disclosure are described in detail as follow. In one example, the pixel driving circuit, having the structure of 7T1C, may conduct a reset operation, (i.e., during a reset phase), a threshold voltage compensating operation (i.e., during a threshold voltage compensating phase), and an emission driving operation (i.e., during an emission driving phase). FIG. 4 is a timing diagram of each of signals in accordance with one embodiment in the present disclosure.

During the reset phase, referring to FIG. 3 and FIG. 4, the reset signals "Reset" are maintained to be at the low potential. The scanning signals "Scan" are maintain to be at the high potential. The enabling signals "Em" are maintained to be at the low potential during a first predetermined time period A1. The enabling signals "Em" transits from the low potential into the high potential when the first predetermined time period A1 expires. That is, the enabling signals "Em" and the reset signals "Reset" are maintained to be at the low potential during the first predetermined time period A1.

The fourth TFT T4 is turned on to provide the reference voltage "$V_{ref}$" to the fourth node "a", i.e., the first end of the capacitor "$C_{st}$". Thus, a voltage "Va" of the fourth node "a" may be equal to "$V_{ref}$" ($Va=V_{ref}$). The fifth TFT T5 is turned on and then turned off to provide a power supply voltage "$V_{dd}$" to the second node "s", i.e., the second end of the capacitor "$C_{st}$" Thus, a voltage "Vs" of the second node "a" may be equal to "$V_{dd}$" ($Vs=V_{dd}$). It is noted that a starting point of the first predetermined time period A1 coincides with a starting point of the reset phase, therefore, the enabling signals "Em" is configured to be at the low potential and transits to the high potential to guarantee the voltage "Vs" of the second node "s" being equal to "$V_{dd}$", i.e., ($Vs=V_{dd}$).

The first TFT T1, the second TFT T2, the third TFT T3, the sixth TFT T6, and the seventh TFT 17 are in a turn-off state during the reset phase.

During the threshold voltage compensating phase, the enabling signals "Em" are maintained to be at the high potential. The reset signals "Reset" are maintained to be at the low potential during a second predetermined time period A2. The reset signals "Reset" transits from the low potential into the high potential when the second predetermined time period A2 expires. The scanning signals "Scan" are maintain to be at the low potential during a third predetermined time period A3, and the scanning signals "Scan" transits from the low potential into the high potential when the third predetermined time period A3 expires. A starting point of the second predetermined time period A2 is the same with a starting point of the third predetermined time period A3, and the second predetermined time period A2 is greater than the third predetermined time period A3.

The second TFT T2 is turned on to provide the data voltage "$V_{data}$" to the first node "g", i.e., the gate electrode of the first TFT T1. The fourth TFT T4 is maintained to be in a turn-on state, so as to maintain a voltage of the first end of the capacitor "$C_{st}$" to be equal to the reference voltage "$V_{ref}$", i.e., the voltage "Va" of the fourth node "a", ($Va=V_{ref}$). The first TFT T1 and the third TFT T3 are turned on such that the second end of the capacitor "$C_{st}$" is discharged until a voltage equal to a voltage difference between the data voltage "$V_{data}$" and a threshold voltage "$V_{th}$" of the first TFT T1 via a path of the first TFT T1 and the third TFT T3, and the first TFT T1 is turned off. That is, the voltage "Vs" of the second node "s" is equal to ($V_{data}-V_h$), wherein "$V_{th}$" is the threshold voltage of the first TFT T1.

The fifth TFT T5, the sixth TFT T6, and the seventh TFT T7 are in the turn-off state during the threshold voltage compensating phase.

During the emission driving phase, the enabling signals "Em" are maintained to be at the low potential, and the reset signals "Reset" and the scanning signals "Scan" are maintained to be at the high potential. The fifth TFT T5 is turned on to provide the power supply voltage "$V_{dd}$" to the second node "s", i.e., the first end of the first TFT T1. The voltage "Vs" of the second node "s" is equal to "$V_{dd}$" ($Vs=V_{dd}$). The seventh TFT T7 is turned on to provide a voltage of the capacitor "$C_{st}$" to the first node "g", i.e., the gate electrode of the first TFT T1. The voltage "Vg" of the first node "g" is equal to ($V_{dd}-V_{data}+V_{th}+V_{ref}$), i.e., ($Vg=V_{dd}-V_{data}+V_{th}+V_{ref}$). The sixth TFT T6 is turned on such that a driving current being provided from the second end of the first TFT T1 to the OLED via the sixth TFT T6.

As such, the driving current "I" passing through the OLED may be represented as below:

$$I=k(Vgs-Vth)^2=k(V\text{ref}+Vth-V\text{data}-Vth)^2=k(V\text{ref}-V\text{data})^2 \quad (1)$$

A voltage difference "Vgs" between the first node "g" and the second node "s" is equal to (Vg−Vs), i.e., ($Vgs=Vg-Vs=V_{dd}-V_{data}+V_{th}+V_{ref}-V_{dd}=V_{ref}-V_{data}+V_{th}$), wherein "k" is an intrinsic conductance factor of the first TFT T1, which is determined by characters of the first TFT T1.

It can be noted that, in the equation (1), the driving current "I" passing through the OLED is not related to the threshold voltage "$V_{th}$" of the first TFT T1. As such, the improper image-displaying of the OLED display resulting from the drifting of the threshold voltage of the driving TFT may be eliminated.

The second TFT T2, the third TFT T3, and fourth TFT T4 are in the turn-off state during the emission driving phase.

In view of the above, the current passing through the OLED may not be related to the threshold voltage of the driving TFT. So as to eliminate the improper image-displaying of the OLED display resulting from the drifting of the threshold voltage of the driving TFT.

The above description is merely the embodiments in the present disclosure, the claim is not limited to the description thereby. The equivalent structure or changing of the process of the content of the description and the figures, or to implement to other technical field directly or indirectly should be included in the claim.

What is claimed is:

1. A pixel driving circuit, comprising:

a first thin film transistor (TFT), a second TFT, a third TFT, a fourth TFT, a fifth TFT, a sixth TFT, a seventh TFT, a capacitor, and an organic light-emitting diode (OLED);

wherein, during a reset phase, the fourth TFT is turned on to provide a reference voltage to a first end of the capacitor, and the fifth TFT is turned on and then turned off to provide a power supply voltage to a second end of the capacitor;

during a threshold voltage compensating phase, the second TFT is turned on to provide a data voltage to a gate electrode of the first TFT, the fourth TFT is maintained to be in a turn-on state, so as to maintain a voltage of the first end of the capacitor to be equal to the reference voltage, and the first TFT and the third TFT are turned on such that the second end of the capacitor is discharged until a voltage equal to a voltage difference between the data voltage and a threshold voltage of the first TFT, and the first TFT is turned off;

during an emission driving phase, the fifth TFT is turned on to provide the power supply voltage to the first end of the first TFT, the seventh TFT is turned on to provide a voltage of the capacitor to the gate electrode of the first TFT, the sixth TFT is turned on such that a driving current being provided from the second end of the first TFT to the OLED via the sixth TFT.

2. The pixel driving circuit according to claim 1, wherein the first TFT, the second TFT, the third TFT, the sixth TFT, and the seventh TFT are in a turn-off state during the reset phase.

3. The pixel driving circuit according to claim 1, wherein the fifth TFT, the sixth TFT, and the seventh TFT are in a turn-off state during the threshold voltage compensating phase.

4. The pixel driving circuit according to claim 1, wherein the second TFT, the third TFT, and fourth TFT are in a turn-off state during the emission driving phase.

5. The pixel driving circuit according to claim 1, wherein the gate electrode of the first TFT connects to a first node, a first end of the first TFT connects to a second node, and a second end of the first TFT connects to a third node;

a gate electrode of the second TFT is configured to receive scanning signals, a second end of the second TFT connects to the first node, and a first end of the second TFT is configured to receive the data voltage;

a gate electrode of the third TFT is configured to receive the scanning signals, a second end of the third TFT connects to the third node, and a first end of the third TFT connects to the first node;

a gate electrode of the fourth TFT is configured to receive reset signals, a first end of the fourth TFT is configured to receive the reference voltage, and a second end of the fourth TFT connects to a fourth node;

a gate electrode of the fifth TFT is configured to receive enabling signals, a first end of the fifth TFT is configured to receive the power supply voltage, and a second end of the fifth TFT connects to the second node;

a gate electrode of the sixth TFT is configured to receive the enabling signals, a first end of the sixth TFT connects to the third node, and a second end of the sixth TFT connects to the OLED;

a gate electrode of the seventh TFT is configured to receive the enabling signals, a first end of the seventh TFT connects to the fourth node, and a second end of the seventh TFT connects the first node;

a first end of the capacitor connects to the fourth node, and a second end of the capacitor connects to the second node.

6. The pixel driving circuit according to claim 5, wherein, during the reset phase, the reset signals are maintained to be at a low potential, the scanning signals are maintained to be at a high potential, the enabling signals are maintained to be at the low potential during a first predetermined time period, and the enabling signals transits from the low potential into the high potential when the first predetermined time period expires.

7. The pixel driving circuit according to claim 5, wherein, during the threshold voltage compensating phase, the enabling signals are maintained to be at the high potential, the reset signals are maintained to be at the low potential during a second predetermined time period, the reset signals transits from the low potential into the high potential when the second predetermined time period expires, the scanning signals are maintain to be at the low potential during a third predetermined time period, and the scanning signals transits from the low potential into the high potential when the third predetermined time period expires.

8. The pixel driving circuit according to claim 5, wherein, during the emission driving phase, the enabling signals are maintained to be at the low potential, and the reset signals and the scanning signals are maintained to be at the high potential.

9. The pixel driving circuit according to claim 1, wherein the first TFT, the second TFT, the third TFT, the fourth TFT, the fifth TFT, the sixth TFT, and the seventh TFT are P-trench TFTs.

10. A display device, comprising:

a pixel driving circuit, wherein the pixel driving circuit, comprising: a first thin film transistor (TFT), a second TFT, a third TFT, a fourth TFT, a fifth TFT, a sixth TFT, a seventh TFT, a capacitor, and an OLED;

wherein, during a reset phase, the fourth TFT is turned on to provide a reference voltage to a first end of the capacitor, and the fifth TFT is turned on and then turned off to provide a power supply voltage to a second end of the capacitor;

during a threshold voltage compensating phase, the second TFT is turned on to provide a data voltage to a gate electrode of the first TFT, the fourth TFT is maintained to be in a turn-on state, so as to maintain a voltage of the first end of the capacitor to be equal to the reference voltage, and the first TFT and the third TFT are turned on such that the second end of the capacitor is discharged until a voltage equal to a voltage difference between the data voltage and a threshold voltage of the first TFT, and the first TFT is turned off;

during an emission driving phase, the fifth TFT is turned on to provide the power supply voltage to the first end of the first TFT, the seventh TFT is turned on to provide a voltage of the capacitor to the gate electrode of the first TFT, the sixth TFT is turned on such that a driving current being provided from the second end of the first TFT to the OLED via the sixth TFT.

11. The display device according to claim 10, wherein the first TFT, the second TFT, the third TFT, the sixth TFT, and the seventh TFT are in a turn-off state during the reset phase.

12. The display device according to claim 10, wherein the fifth TFT, the sixth TFT, and the seventh TFT are in a turn-off state during the threshold voltage compensating phase.

13. The display device according to claim 10, wherein the second TFT, the third TFT, and fourth TFT are in a turn-off state during the emission driving phase.

14. The display device according to claim 10, wherein the gate electrode of the first TFT connects to a first node, a first end of the first TFT connects to a second node, and a second end of the first TFT connects to a third node;

a gate electrode of the second TFT is configured to receive scanning signals, a second end of the second TFT connects to the first node, and a first end of the second TFT is configured to receive the data voltage;

a gate electrode of the third TFT is configured to receive the scanning signals, a second end of the third TFT connects to the third node, and a first end of the third TFT connects to the first node;

a gate electrode of the fourth TFT is configured to receive reset signals, a first end of the fourth TFT is configured to receive the reference voltage, and a second end of the fourth TFT connects to a fourth node;

a gate electrode of the fifth TFT is configured to receive enabling signals, a first end of the fifth TFT is configured to receive the power supply voltage, and a second end of the fifth TFT connects to the second node;

a gate electrode of the sixth TFT is configured to receive the enabling signals, a first end of the sixth TFT connects to the third node, and a second end of the sixth TFT connects to the OLED;

a gate electrode of the seventh TFT is configured to receive the enabling signals, a first end of the seventh TFT connects to the fourth node, and a second end of the seventh TFT connects the first node;

a first end of the capacitor connects to the fourth node, and a second end of the capacitor connects to the second node.

15. The display device according to claim 14, wherein, during the reset phase, the reset signals are maintained to be at a low potential, the scanning signals are maintained to be at a high potential, the enabling signals are maintained to be at the low potential during a first predetermined time period, and the enabling signals transits from the low potential into the high potential when the first predetermined time period expires.

16. The display device according to claim 14, wherein, during the threshold voltage compensating phase, the enabling signals are maintained to be at the high potential, the reset signals are maintained to be at the low potential during a second predetermined time period, the reset signals transits from the low potential into the high potential when the second predetermined time period expires, the scanning signals are maintain to be at the low potential during a third predetermined time period, and the scanning signals transits from the low potential into the high potential when the third predetermined time period expires.

17. The display device according to claim 14, wherein, during the emission driving phase, the enabling signals are maintained to be at the low potential, and the reset signals and the scanning signals are maintained to be at the high potential.

18. The display device according to claim 10, wherein the first TFT, the second TFT, the third TFT, the fourth TFT, the fifth TFT, the sixth TFT, and the seventh TFT are P-trench TFTs.

* * * * *